US007347741B1

(12) United States Patent
Yeomans et al.

(10) Patent No.: US 7,347,741 B1
(45) Date of Patent: Mar. 25, 2008

(54) CONTACT WITH LOCKING LANCES

(75) Inventors: Michael Anthony Yeomans, Camp Hill, PA (US); Navin Kanjibhai Patel, Mechanicsburg, PA (US); Ricardo L. Koller, Lititz, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/623,587

(22) Filed: Jan. 16, 2007

(51) Int. Cl.
*H01R 13/428* (2006.01)

(52) U.S. Cl. ..... 439/744; 439/746; 439/748

(58) Field of Classification Search ..... 439/744, 439/745, 746, 748, 751, 874
See application file for complete search history.

(56) References Cited

U.S. PATENT DOCUMENTS

| | | | | |
|---|---|---|---|---|
| 4,717,354 | A * | 1/1988 | McCleerey | 439/444 |
| 6,443,768 | B1 * | 9/2002 | Dirkers et al. | 439/607 |
| 6,890,192 | B2 * | 5/2005 | Riku | 439/108 |
| 6,979,238 | B1 * | 12/2005 | Mongold et al. | 439/874 |

* cited by examiner

*Primary Examiner*—Tho D. Ta

(57) ABSTRACT

A connector apparatus is provided as having an insulated housing and a terminal that is secured inside the insulated housing with locking lances. The locking lances have scalloped edges to ensure that the lances only partially penetrate the housing, but also provide a secure connection to provide an increased retention of the terminal in the housing. Once the terminal is secured within the housing, the terminal is permanently disposed within the housing and cannot easily be removed.

18 Claims, 6 Drawing Sheets

CONTACT WITH LOCKING LANCES

BACKGROUND OF THE INVENTION

The present invention is directed to a wire terminal with locking lances. More specifically, the present invention is directed to a wire terminal with locking lances that provide a secure connection in an insulated housing.

The connector contact with locking lances is described as being used for neonatal pre-wired electrodes, however, it is to be understood that the connector can be used for any suitable purpose or application and is not limited to use with neonatal pre-wired electrodes. Prior applications for the connector included a soft insulated housing, and a conductive terminal that was disposed within the insulated housing. The housing insulates the terminal and to prevent the terminal from contacting an outside object, creating an electrical short circuit, introducing damaging voltage transients to the equipment, or presenting a hazard of electrical shock to personnel. Furthermore, as these lances are used in neonatal applications, the conductive terminal must be well insulated to prevent causing an electrical shock to any infants, pregnant women or health care workers who may be exposed to the connectors.

One problem with the current application of the connector is that the terminal is not sufficiently secured in the insulated housing, creating a risk of the terminal separating from the housing when minimal force is applied. When separation occurs and the conductive terminal becomes exposed the equipment may be damaged, and personnel may incur an electrical shock. To remedy this situation, one prior art terminal was modified to include locking lances with sharp edges to engage in the insulated housing once inserted into the housing. This alleviated the problem of low retention force for the terminal, however, the sharp edges of the locking lances eventually cut through the outer housing wall. This posed another hazard, in addition to those stated above, as the sharp edges projected outside of the housing, exposing personnel and patients to risk of laceration.

A prior art contact having locking lances is illustrated in FIGS. 1 and 2. FIG. 1 shows a top view of the terminal 10 of the contact, while FIG. 2 illustrates a side view of the terminal 10. The insulated housing (not shown) for the connector is similar to the insulated housing used for the present invention, which will be described in the detailed description below. The terminal 10 is tubular and elongated with rounded edges. The terminal 10 has two locking lances 12 that project from the surface of the terminal 10. Each locking lance 12 has a sharp edge 14. This edge 14 is configured to secure into the insulated housing when the terminal 10 is inserted into the housing.

Therefore, what is needed is a connector with locking lances with an insulated housing and terminal that is secure once inserted into the housing, and can maintain the insulating properties throughout the working life of the connector.

SUMMARY OF THE INVENTION

One embodiment of the present invention is directed to a wire terminal apparatus including a connector socket having at least one locking lance with a scalloped edge with at least one point extending outwardly from at least one end of the scalloped edge. The present invention also includes a wire barrel connected to the connector socket having at least one deformable portion and an insulation barrel connected to the wire barrel having at least one deformable portion. The connector socket, wire barrel, and insulation barrel are configured to receive an electrically conductive protrusion, and at least one deformable portion of the wire barrel and at least one deformable portion of the insulation barrel are substantially deformable to secure the electrically conductive protrusion in place.

Another embodiment of the present invention is direct to an electrical connector apparatus including a hollow insulated housing element having an outer shell, and an inner conduit, and a wire terminal apparatus having a connector socket having at least one locking lance with a scalloped edge with at least one point extending outwardly from at least one end of the scalloped edge. The wire terminal also includes a wire barrel connected to the connector socket having at least one deformable portion, and an insulation barrel connected to the wire barrel having at least one deformable portion. The connector socket, wire barrel, and insulation barrel are configured to receive an electrically conductive protrusion, and at least one deformable portion of the wire barrel and at least one deformable portion of the insulation barrel being substantially deformable to secure the electrically conductive protrusion in place. Further, the wire terminal apparatus is inserted into the housing element and at least one locking lance engages the outer shell of the insulated housing element to secure the wire terminal within the housing element and when inserted into the housing element, the wire terminal is substantially insulated by the housing.

The present invention is also directed to a method for a connector apparatus including the steps of providing an insulated housing element having an outer shell and an inner channel configured to receive a wire terminal apparatus, providing a wire terminal apparatus configured to secure an electrically conductive protrusion and having at least one locking lance and inserting the wire terminal apparatus into the insulated housing element with an insertion force. The method also includes the step of applying a securing force to the wire terminal that is an opposite force to the insertion force. The insertion force causes at least one locking lance of the wire terminal apparatus to partially penetrate the outer shell of the insulated housing.

One advantage of the present invention includes a connector that is completely insulated having no conductive edges exposed.

One advantage of the present invention is that the terminal becomes secured in place once inserted into the insulated housing.

Another advantage of the present invention is the increased retention of the terminal in the insulated housing.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
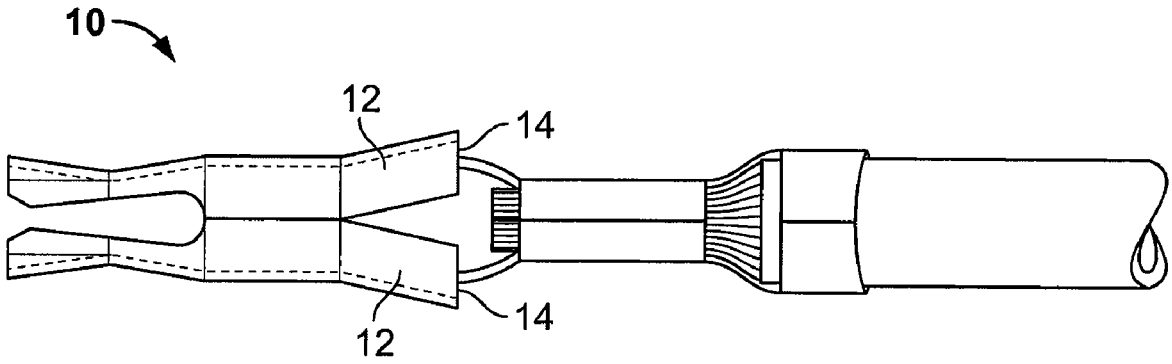
FIG. 1 (Prior Art)
FIG. 1 is a top view of a prior art terminal.
Figure 2:
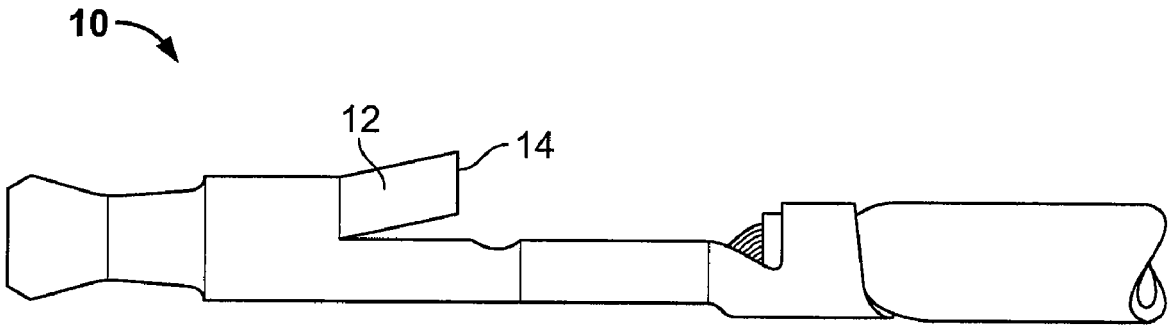
FIG. 2 (Prior Art)
FIG. 2 is a side view of a prior art terminal.
Figure 3:
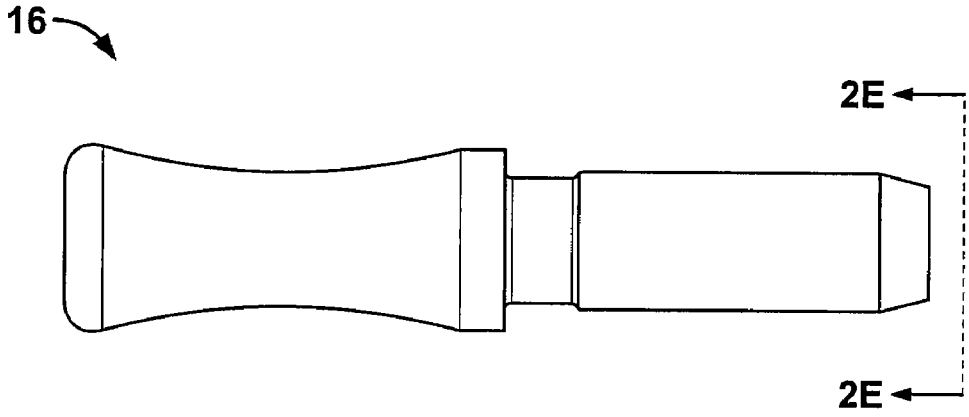
FIG. 3 is a side view of an insulated housing.
Figure 4:
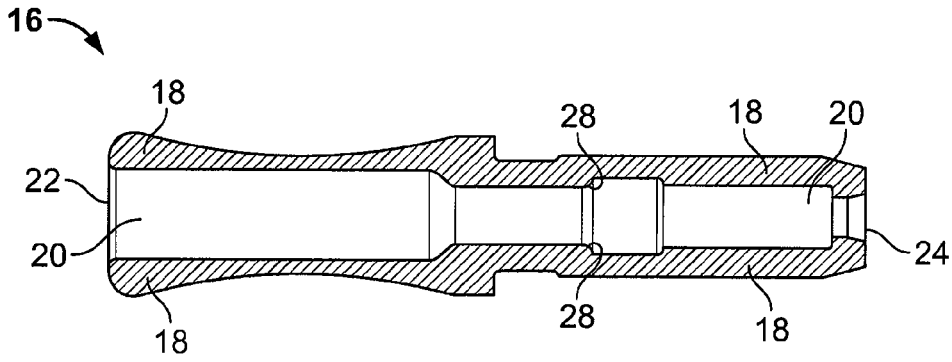
FIG. 4 is a cross sectional view of an insulated housing.

Referring to FIGS. 3 and 4, one embodiment of an insulated housing 16 for the present invention is shown. While this embodiment is shown and described in detail, it is understood that this is only one embodiment of an insulated housing that can be used for the present invention. Any suitable insulated housing may be used with the wire terminal of the present invention. The embodiment of the housing 16 is a substantially tubular, elongated piece with rounded edges, although it will be appreciated that any suitable connector shape may be used for the housing 16. The housing 16 has an outer shell 18, with an inner channel 20. The inner channel 20 is formed such that sections taper gradually downward from the insert opening 22 to the socket end 24 at the opposite end of housing 16. The ridge 28 acts as a detent preventing the locking lances 12 (see, e.g., FIGS. 8-9) from backing out of the insert opening 22 when the lances are fully inserted into the housing 16.

Figure 5:
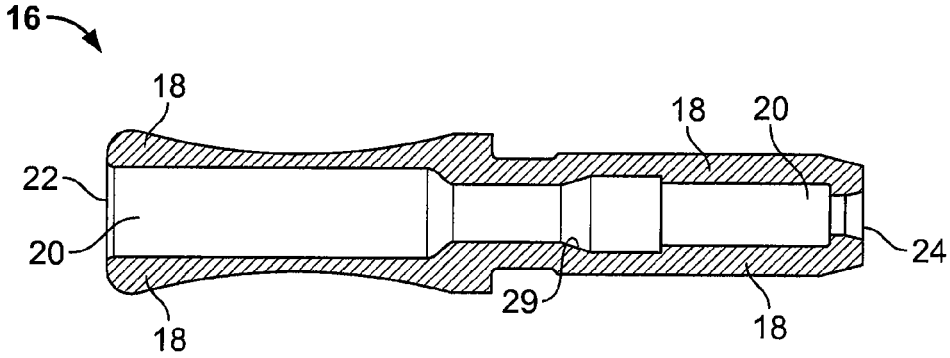
FIG. 5 a cross sectional view of an alternate embodiment of the insulated housing.

The housing 16 of this embodiment is designed to have distinct sections with ridges 28. However, actual during manufacturing the housing 16, the ridges 28 are not as distinct as shown in FIG. 4. FIG. 5 illustrates a cross sectional view of another embodiment of the housing 16 of the present invention with slopes 29, rather than distinct ridges (FIG. 4). In this embodiment, the inner channel 20 tapers at the transition between the various sections, having slopes 29 instead of ridges (FIG. 4). The annular conduit 20 is sized such that the terminal 10 (see, e.g., FIGS. 8 & 9) can be inserted into the insert opening 22 and fits snugly within the annular conduit 20. The friction fit assists to secure the terminal 10 and prevent the terminal 10 from slipping out of the insulated housing 16 after insertion.

Figure 6:
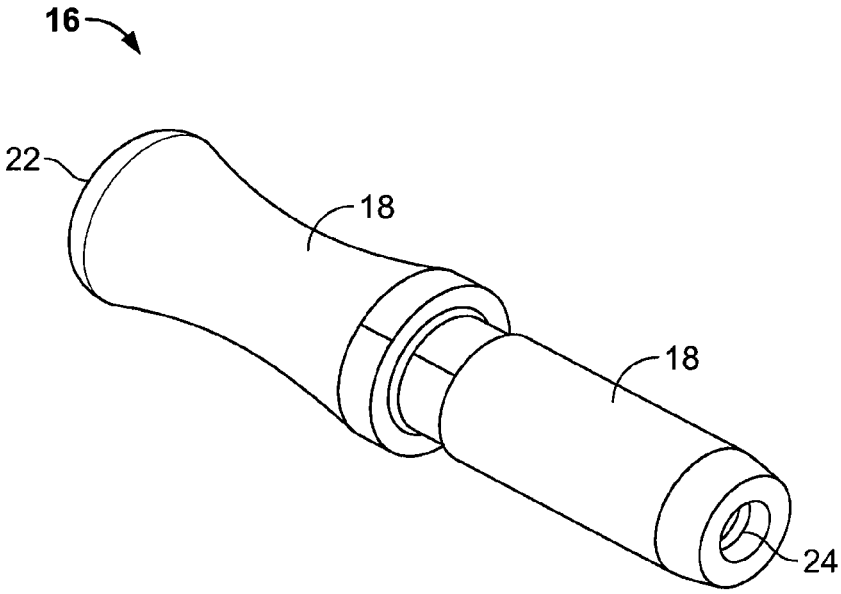
FIG. 6 is a perspective view of an insulated housing of the present invention.

Referring to FIG. 6, the outside surface of the housing 16 is shown in perspective, illustrates the difference in the radial size of the housing from the insert opening 22 to the socket end 24. Although the exterior profile of the housing is not required to match the profile of the conduit 20, in this example the housing exterior profile is substantially the same as conduit 20. The outside surface of the housing 16 may be ergonomically shaped to fit a user's hand. The housing 16 is preferably molded from a low-density polyethylene; however, any suitable plastic or other electrically insulating material may be used. In addition, while the housing 16 is preferably molded, any suitable process may be employed to manufacture the housing 16.

Figure 7:
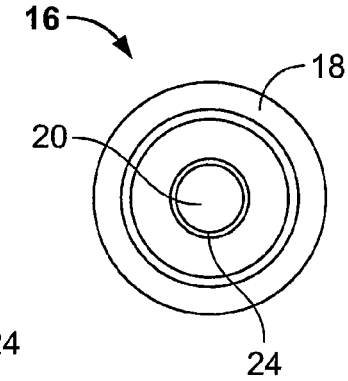
FIG. 7 is a front view of the housing taken along the lines 2E-2E in FIG. 3.
Figure 8:
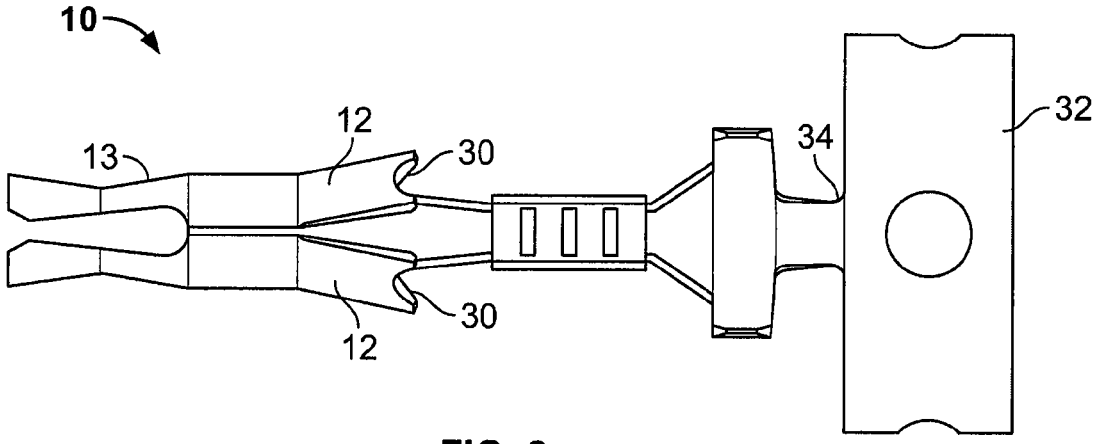
FIG. 8 is a top view of the wire terminal.
Figure 9:
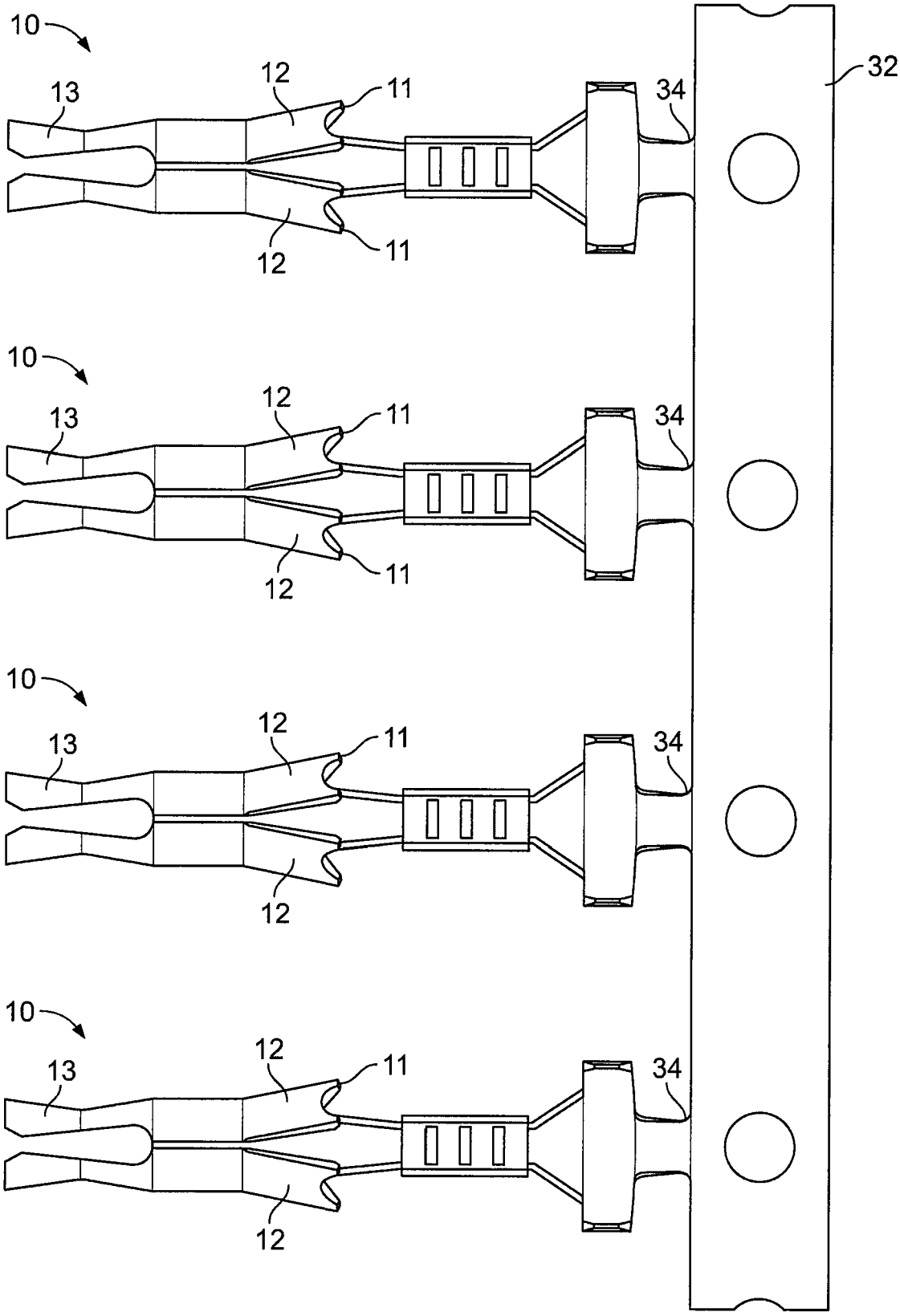
FIG. 9 is an illustration of a partial string of terminals connected by breakaway tabs for packaging in quantities.

Referring to FIG. 7 the connector housing 16 is substantially circular in cross-section, with the conduit 20 also being substantially conical to enable the opening 20 to receive the substantially cylindrical or tubular terminal 10 (see, e.g., FIGS. 8 & 9). Several concentric rings are shown to indicate the various sections have varying inside diameters, as the inner annular conduit 20 tapers to snugly engage the terminal 10. The annular conduit 20 extends from the insert opening 22 to the socket end 24, and provides an opening at either end 22, 24 of the annular conduit 20. A wire or other conductor (not shown) is secured to the terminal 10 and protrudes from the opening 22 of the housing 16 to carry electrical current from a signal or power source, for example, electrodes for a neonatal electrode device.

FIG. 8 illustrates the terminal 10 of the present invention as shown from the top view. The locking lances 12 are shown as having a curved or scalloped edge 30. In addition to the scallop 30, the edges of the locking lances 12 are coined—i.e., partially flat and partially beveled—so that they are not razor sharp as are the prior art lances 12. The scalloped and coined edges 30 prevent the locking lances from protruding through the housing 16, while the pointed ends 11 of the locking lances 12 protrude partially into the housing 16. The locking lances 12 are flexible, and when inserted past the ridge 28 in the conduit 20, tend to flex outwardly towards the annular wall of the conduit 20. Thus when the terminal tends to pull out of the conduit towards the insert opening, the points 11 of the locking lances 12 are set in the ridge 28 or in the annular wall of the conduit 20 and prevented from pulling further out of the housing 16.

A detachable tab 32 is shown connected to one end of the terminal 10. A quantity of terminals 10 may be manufactured with tabs 32 in a continuous strip, as shown in FIG. 9, for use in mass production assembly machines. However, it is to be understood that the terminals 10 can be manufactured without tabs 32, and that the tabs 32 are intended to be removed before or after wire crimping. A female connector socket 13 is formed at the opposite end of the terminal 10 for accepting an external male connector end (not shown). Alternately, a male connector end may be configured with the housing 16.

Figure 10:
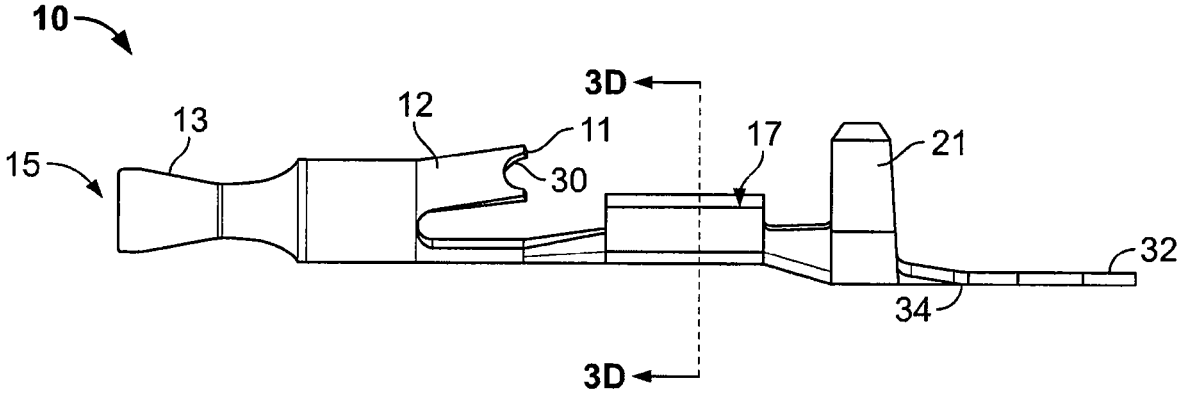
FIG. 10 is a side view of the terminal.

Referring to FIG. 10, the locking lances 12 project radially outwardly at an angle from the axis of the terminal 10. The locking lances 12 project from the terminal 10 at such an angle that the locking lances 12 can secure into the housing (FIG. 3) to create a secure fit once inserted into the housing (FIG. 3). The housing is constructed of low-density polyethylene or any other suitable plastic or electrical insulator having a low coefficient of friction, to enable insertion of the terminal 10 and to provide a secure fit to the terminal 10. Thus, the locking lances 12 provide a fastening means for the terminal 10 in the housing 16 to prevent the terminal 10 from sliding out of the housing 16 once it is inserted. The terminal 10 is inserted into the housing 16 with the female socket 13 of the terminal 10 entering the insert opening 22 of the housing 16. A slight force is applied to the terminal 10, as if the terminal 10 is being removed from the housing 16, and the locking lances 12 catch in the housing walls. Because the locking lances 12 have a scalloped edge 30, when the locking lances 12 catch in the housing 16 only the end points 11 penetrate a portion of the wall of the housing 16. Thus the locking lances 12 do not cut entirely through the housing wall. In other words, the locking lances 12 remain fully insulated and do not become exposed on the outside of the housing shell 16. Once the locking lances 12 are fully engaged in the housing walls, the terminal 10 is secured in the housing 16 and cannot be removed.

FIG. 10 also shows the wire barrel 17 portion of the terminal 10. Wire (not shown) that is secured in the terminal 10 is first stripped of any coating or insulating layer and the wire is placed across the tab 32, through the insulation barrel 21 and ending in the wire barrel 17. Only the bar exposed portion of the wire (not shown) is disposed in the wire barrel 17. The remainder of the wire that lies across the insulation barrel 21 remains insulated with a coating or layer. Before insertion into the insulated housing (FIG. 14), the insulation barrel 21 and wire barrel 17 are both crimped onto the wire to create a secure connection with the wire in the terminal 17. While crimping the wire is the preferred method of securing the wire into the terminal, it is understood that other securing means may be used such as soldering, the use of both soldering and crimping, or any other securing method that is suitable for the terminal. Upon crimping, the wire barrel 17 is flat against the wire, as well as the insulation barrel 21. The insulation barrel 21 provides strain relief on the wire, in the event that forces are applied to the wire, the forces are absorbed by the insulation barrel 21 and the wire barrel 17, where the electrical connection is made between the terminal 10 and the stripped wire. When the wire is crimped with the insulation barrel 21 and the wire barrel 17, the tab 32 is removed. Thus, the entire length of the remainder of the terminal 10 is inserted into and surrounded by the insulated housing (FIG. 14).

Figure 11:
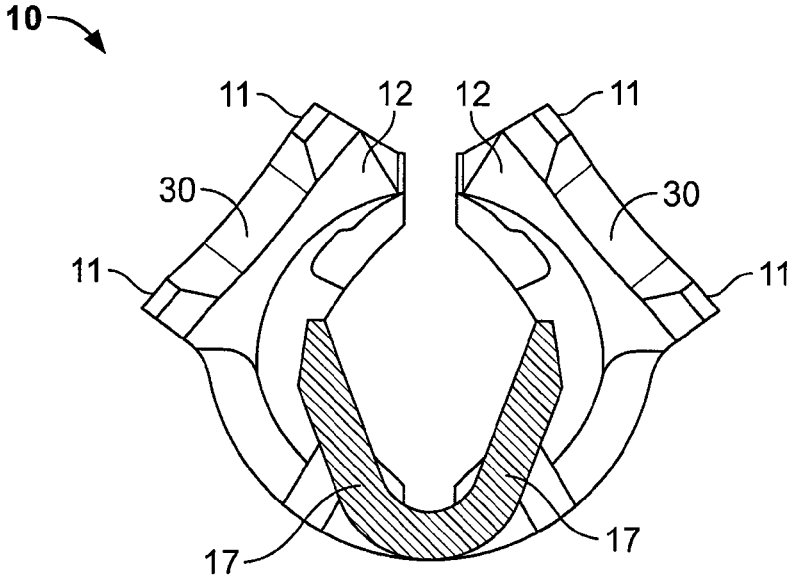
FIG. 11 is an end view of the terminal taken along the lines 3D-3D in FIG. 10.
Figure 12:
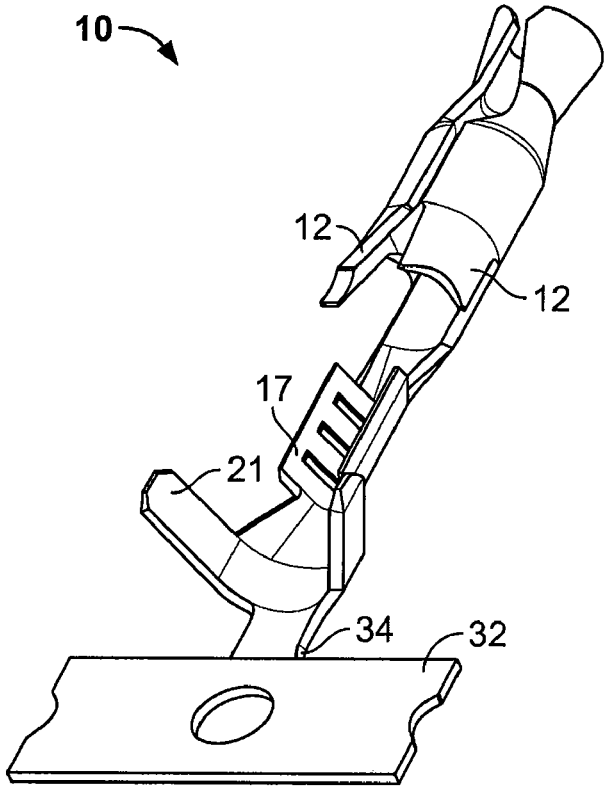
FIG. 12 is a perspective view of the terminal.

FIG. 11 illustrates the terminal 10 end view. The locking lances 12 project radially outwardly from the axis 15 of the terminal 10, which enables the locking lances 12 to engage in and penetrate the housing 16 walls to create a secure fit for the terminal 10 once inserted into the housing 16. The wire barrel 17 is deformable for crimping over the wire conductors inserted into the terminal as discussed previously with FIG. 10. FIG. 12 illustrates a perspective view of the terminal 10, which illustrates the tubular or cylindrical shape of the terminal 10. The locking lances 12 are shown as projecting at an angle from the body of the terminal 10. Preferably, the terminal 10 is manufactured from a stamping process and is a brass or bronze material with tin plating. However, it is to be understood that any other process may be used for manufacture, and any other conductive material may be used for the terminal 10 and plating.

Figure 13:
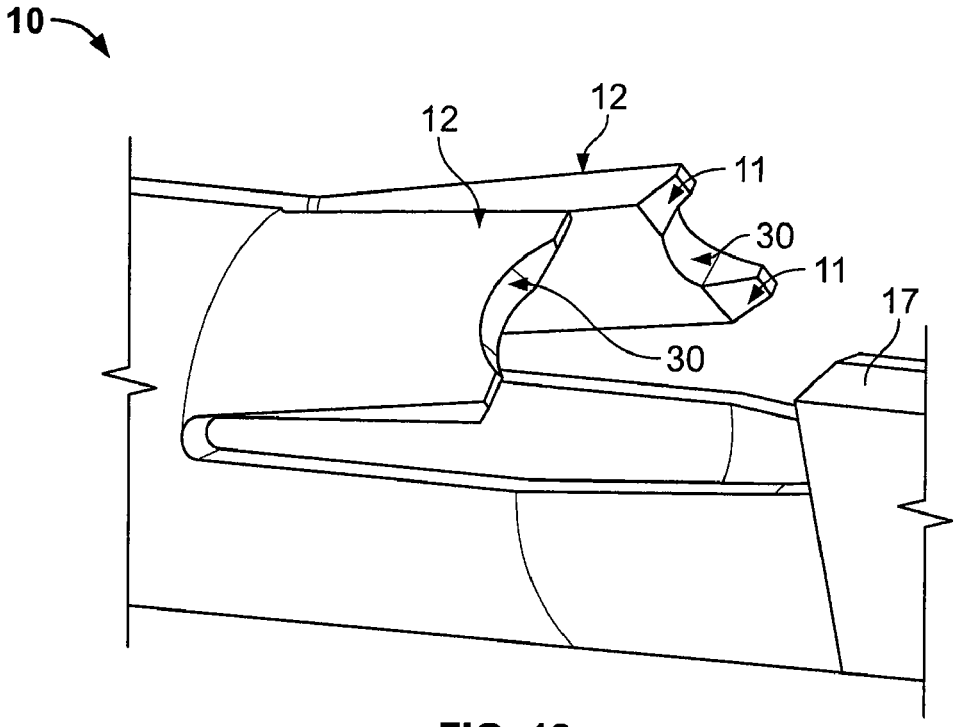
FIG. 13 is a close up view of the locking lances on the terminal of the present invention.

FIG. 13 illustrates a close up of the locking lances 12 on the terminal 10. The terminal is preferably configured to have 2 locking lances 12, however, one single locking lance 12 may be used, or more than two locking lances 12 may be used, if suitable for the invention. It should be know that if a different number of locking lances 12 are used other than 2, the position of the locking lances 12 may be adjusted on the terminal 10 to provide the best possible secure fit for the terminal 10 in the housing 16. The scalloped edges 30 are provided to facilitate coining the sharp tips during manufacture. The scalloped edge 30 also provides bearing surfaces to limit penetration through the entire housing outer shell (FIG. 3) and to provide a strong retention force to the terminal 10. The sharp points 11 are also tapered to allow the locking lance to initiate penetration into the housing wall. The initial penetration is needed to keep the terminal 10 from sliding out of the housing 16 once it is inserted to avoid electrical shock or electrical shorting.

Figure 14:
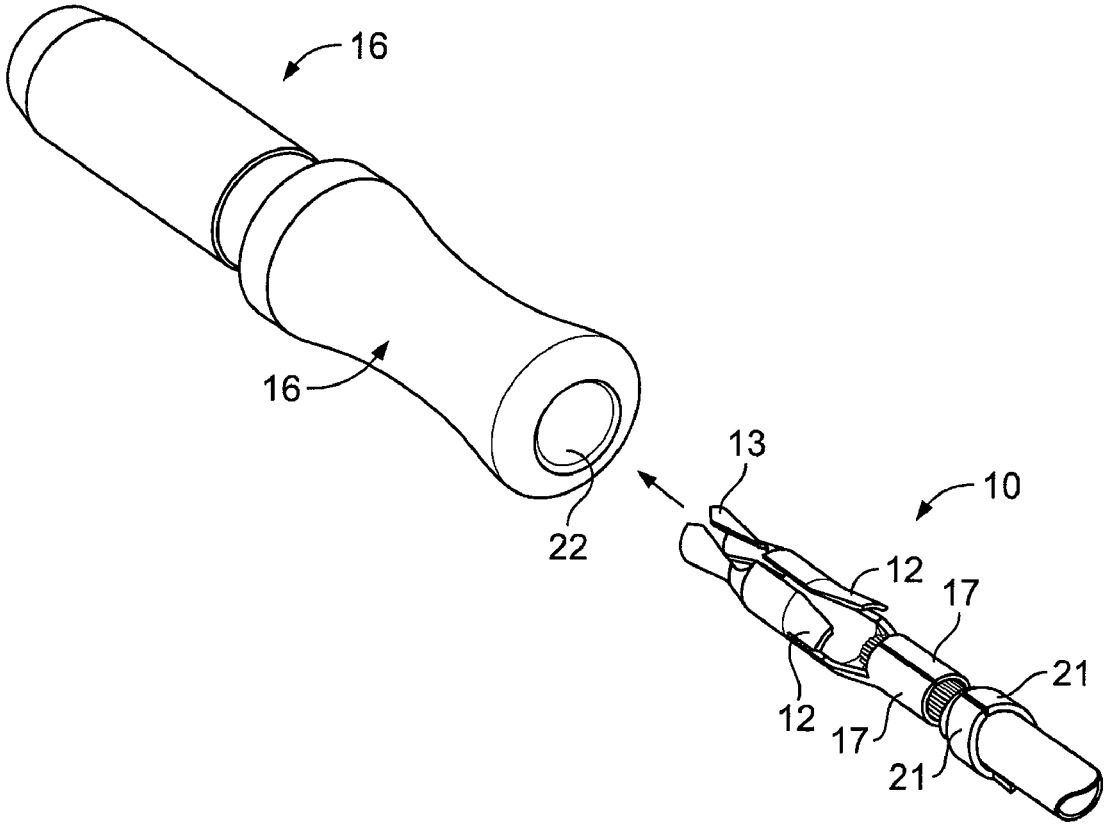
FIG. 14 illustrates the terminal being inserted into the housing of the present invention.

FIG. 14 illustrates the direction in which the terminal 10 is inserted into the housing 16. The terminal 10 is inserted into the insert opening 22 of the housing and pushed in through the inner annular conduit 20 until all but the tab 32 on the terminal 10 is surrounded by the housing 16. The terminal 10 in FIG. 14 also is shown as having a crimped connection with conductive material. While any conductive material may be used, preferably, twenty-six AWG wire is a typical wire gauge that is used with the present invention. The wire is stripped of an insulated coating, and the exposed conductive end is placed in the wire barrel 17. A portion of the wire with the insulative coating is placed in the insulation barrel 21. The ends of the wire barrel 17 and the insulative barrel 21 are displaced downward over the exposed portion of the wire and the insulated portion of the wire to crimp and secure the wire into place in the terminal 10. The socket 13 is configured to mate with a compatible male connector end (not shown).

Figure 15:
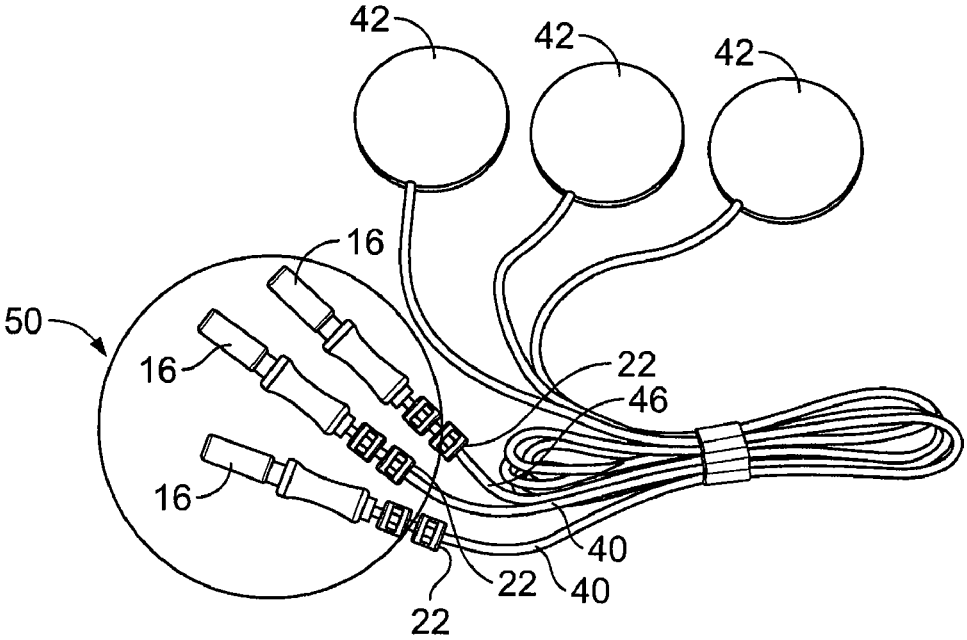
FIG. 15 is an illustration of the present invention with the terminal secured in the insulated housing.

FIG. 15 illustrates one embodiment of the present invention 50 in a neonatal pre-wired electrode 42. The terminal 10 has been inserted and secured into the housing 16. A wire 40 protrudes from the housing 16 from the insert opening 22 and connects to the electrodes 42. The socket end 24 can accept any male connector plug apparatus to conduct electrical current or charge to the electrodes 42.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wire terminal apparatus comprising:

a connector socket having at least one locking lance with a scalloped edge with at least one point having a coined edge, the at least one point extending outwardly from the at least one end of the scalloped edge;

a wire barrel connected to the connector socket, the wire barrel having at least one deformable portion;

an insulation barrel connected to the wire barrel, the insulation barrel having at least one deformable portion; and wherein the connector socket and locking lance are monolithic; and the connector socket and locking lance, wire barrel, and insulation barrel are configured to receive an electrically conductive protrusion, and the at least one deformable portion of the wire barrel and the at least one deformable portion of the insulation barrel being substantially deformable to secure the electrically conductive protrusion in place.

2. The wire terminal apparatus of claim 1 wherein the connector socket is a female connector.

3. The wire terminal apparatus of claim 1 wherein the connector socket is a male connector.

4. The wire terminal apparatus of claim 1 wherein the electrically conductive protrusion is a wire.

5. The wire terminal apparatus of claim 1 wherein the connector socket has two locking lances having two points extending outwardly from the ends of the scalloped edge.

6. An electrical connector apparatus comprising:

a hollow insulated housing element having an outer shell, and an inner conduit;

a wire terminal apparatus having:

a connector socket having at least one locking lance with a scalloped edge with at least one point having a coined edge, the at least one point extending outwardly from the at least one end of the scalloped edge;

a wire barrel connected to the connector socket, the wire barrel having at least one deformable portion;

an insulation barrel connected to the wire barrel, the insulation barrel having at least one deformable portion;

wherein the connector socket and locking lance are monolithic; and the connector socket and locking lance, wire barrel, and insulation barrel are configured to receive an electrically conductive protrusion, and the at least one deformable portion of the wire barrel and the at least one deformable portion of the insulation barrel being substantially deformable to secure the electrically conductive protrusion in place; and wherein the wire terminal apparatus is inserted into the housing element and the at least one locking lance engages the outer shell of the insulated housing element to secure the wire terminal within the housing element and when inserted into the housing element, the wire terminal is substantially insulated by the housing.

7. The connector apparatus of claim 6 wherein the wire terminal is manufactured from a stamping process.

8. The connector apparatus of claim 6 wherein the locking lances partially penetrate the outer shell of the insulating housing.

9. The wire terminal apparatus of claim 6 wherein the connector socket is a female connector.

10. The wire terminal apparatus of claim 6 wherein the connector socket is a male connector.

11. The wire terminal apparatus of claim 6 wherein the electrically conductive protrusion is a wire.

12. The wire terminal apparatus of claim 6 wherein the connector socket has two locking lances having two points extending outwardly from the ends of the scalloped edge.

13. The connector apparatus of claim 6 wherein the housing element is constructed from a low-density polyethylene (LDPE) material.

14. The connector apparatus of claim 13 wherein the housing element is manufactured from a molding process.

15. A method for a connector apparatus comprising the steps of:

providing an insulated housing element having an outer shell and an inner channel configured to receive a wire terminal apparatus;

providing a wire terminal apparatus configured to secure an electrically conductive protrusion and having at least one locking lance with a scalloped edge and an end point having a coined edge;

inserting the wire terminal apparatus into the insulated housing element with an insertion force;

applying a securing force to the wire terminal that is an opposite force to the insertion force; and wherein the wire terminal apparatus and locking lance are monolithic and wherein the insertion force causes the end points having a coined edge of the at least one locking lance of the wire terminal apparatus to partially penetrate the outer shell of the insulated housing, and the scalloped edge limit the penetration depth of the end points into the outer shell.

16. The method of claim 15 wherein the step of providing a wire terminal apparatus further comprises:

providing a connector socket being monolithic with at least one locking lance with a scalloped edge with at least one point extending outwardly from the at least one end of the scalloped edge;

providing a wire barrel connected to the connector socket having at least one deformable portion;

providing an insulation barrel connected to the wire barrel having at least one deformable portion; and wherein the connector socket and locking lance are monolithic; and the connector socket and locking lance, wire barrel, and insulation barrel are configured to receive an electrically conductive protrusion, and the at least one deformable portion of the wire barrel and the at least one deformable portion of the insulation barrel being substantially deformable to secure the electrically conductive protrusion in place.

17. The method of claim 16 further comprising the step of providing an electrically conductive protrusion and securing the electrically conductive protrusion in the wire terminal by substantially deforming the at least one deformable portion of the wire barrel and by substantially deforming the at least one deformable portion of the insulation barrel.

18. The method of claim 17 wherein the step of providing an electrically conductive protrusion and securing the electrically conductive protrusion in the wire terminal is before the step of inserting the conductive terminal into the insulated housing element.

* * * * *